US008163318B2

(12) United States Patent
Ozanne et al.

(10) Patent No.: US 8,163,318 B2
(45) Date of Patent: Apr. 24, 2012

(54) CAPSULE FOR THE PREPARATION OF A BEVERAGE

(75) Inventors: Matthieu Ozanne, Chessel (CH); Loic D'Hoine, Groisy (FR); Joel Bourdeau, Saint Jorioz (FR)

(73) Assignee: Nestec S.A., Vevey (CH)

( * ) Notice: Subject to any disclaimer, the term of this patent is extended or adjusted under 35 U.S.C. 154(b) by 450 days.

(21) Appl. No.: 12/439,627

(22) PCT Filed: Aug. 24, 2007

(86) PCT No.: PCT/EP2007/058799
§ 371 (c)(1),
(2), (4) Date: May 4, 2009

(87) PCT Pub. No.: WO2008/025730
PCT Pub. Date: Mar. 6, 2008

(65) Prior Publication Data

US 2010/0003371 A1 Jan. 7, 2010

(30) Foreign Application Priority Data

Aug. 30, 2006 (EP) ..... 06119796

(51) Int. Cl.
*B65B 29/02* (2006.01)

(52) U.S. Cl. ..... 426/79; 426/77; 99/295; 99/323

(58) Field of Classification Search ..... 426/77–80; 99/295, 323
See application file for complete search history.

(56) References Cited

U.S. PATENT DOCUMENTS

2002/0148356 A1 10/2002 Lazaris et al.
2002/0148357 A1 10/2002 Lazaris et al.
2003/0172813 A1* 9/2003 Schifferle ..... 99/275

FOREIGN PATENT DOCUMENTS

EP 1574452 9/1971
EP 0512468 11/1992
EP 0512470 11/1992
EP 0615921 9/1994

(Continued)

OTHER PUBLICATIONS

International Search Report PCT/EP2007/058799, dated Jan. 3, 2008, 3 pages.

(Continued)

*Primary Examiner* — Drew Becker
*Assistant Examiner* — Luana Z Long
(74) *Attorney, Agent, or Firm* — K&L Gates LLP

(57) ABSTRACT

Capsule for the preparation of a beverage in a beverage machine comprising an enclosure (20) containing one or more beverage ingredients, filtering means (22) delimiting at least one filtering side of the enclosure, beverage flow guiding means (40) for guiding the beverage to a beverage outlet (41*b*) of the capsule, a shell (21) and a protective cover (4) that is attached to the shell in order to form a gas tight container for the beverage ingredients. The capsule further comprises an overflow wall (3) that is positioned in the path of the brewed liquid after the filtering means (22) and comprises at least one overflow aperture (25). The capsule further comprises opening means comprising an opening element (43) configured to open the gas-tight container in order to create the beverage outlet (41). The beverage flow guiding means (40) and the opening element (43) are integrally housed in the gas-tight container.

8 Claims, 10 Drawing Sheets

FOREIGN PATENT DOCUMENTS

| | | | |
|---|---|---|---|
| EP | 1101430 | | 5/2001 |
| EP | 1440903 | | 7/2004 |
| GB | 1256247 | | 12/1971 |
| GB | 1397116 | | 6/1975 |
| WO | WO 2005/066040 | A2 * | 7/2005 |

OTHER PUBLICATIONS

Written Opinion of the International Searching Authority dated Jan. 3, 2008, 7 pages.

* cited by examiner

CAPSULE FOR THE PREPARATION OF A BEVERAGE

The present invention relates to a capsule for preparing and delivering a beverage in a brewing device. The present invention more particularly aims at providing a capsule adapted to deliver brewed tea although other beverages can be successfully brewed in the capsule.

BACKGROUND OF THE INVENTION

Different beverage capsules for brewing beverages in a suitable beverage machine are known. However, there is no existing capsule that can deliver a high quality tea beverage from a capsule containing leaf tea product and the like.

Quality of a tea beverage is highly dependent on the quality of the leaf tea ingredients, i.e., the tea origin used (soil, drying, blending, etc.) and their storage conditions. For instance, tea ingredients are usually sensitive to oxygen and light. Preferred tea ingredients are taken from loose leaves, chiselled or broken in small fragments. However, brewing conditions are also important to take full advantage of the quality of the ingredients used.

Another problem with tea beverages resides in that taste cross-contamination must be preferably avoided. Taste cross-contamination happens when two capsules are sequentially brewed in the machine and when a taste residue is left by the first capsule on permanent parts of the machine that can consequently affect the taste of the second capsule which is brewed just after the first capsule. For tea, this can be an issue with certain tea varieties that deliver a high aroma profile such as mint tea or other highly flavoured varieties. Also tea residue may constitute a soil for bacterial growth and may lead to hygiene issues which need to be tackled.

One commercially successful capsule system for extracting coffee beverage from capsules consists in placing an air- and water-impermeable capsule into an extraction device, injecting hot water into the capsule until the internal pressure in the capsule reaches the value at which a closing membrane is torn or pierced so that liquid extract can be released out of the capsule. A capsule adapted for such a process of extraction is described in EP 0 512 468. The process itself is described in EP 0 512 470. This method provides a high quality espresso-type coffee. The ground coffee is filled in the capsule fresh and can be stored many months without significant loss of aroma. The release of the coffee is slightly delayed due to a retarded opening of the membrane under pressure from the time water starts to be injected in the capsule. As a result, coffee can be fully extracted under optimal pressure and heat conditions. A stable and thick crema or foam is also produced due to high stress, pressure release and gas-entrapment conditions which are specific to this method.

However, such capsule and process are not optimal for carrying out the infusion or brewing of beverages such as tea or herbal tea. The result obtained is poor in term of taste; the beverage has a too high turbidity and may also comprise an undesired foam layer. Therefore, surprisingly a premium quality of tea beverage cannot be reached by such method.

Other capsule systems using pressure for brewing product can only deliver tea beverages that are too turbid, of poor product concentration and/or of taste that is not of sufficient quality for tea experts.

Capsules containing roast and ground coffee in which hot water flows under gravimetric force through the capsule are known. A capsule of this general type is described in British Patent No. 1397116. In this method, water is injected from the top of the cartridge and flows down through the ground coffee, through a filter and finally through a piercing hole or holes of the bottom side. More sophisticated systems are based on a similar approach using trunco-conical cartridges such as in US 2002/0148356 or using rectangular cartridges such as in US 2002/0148357.

EP 0 615 921 relates to a rigid cartridge for coffee, leaf tea or chocolate. The beverage package is used with water flowing in an upward direction. The sidewall of the package is formed from a water-impermeable material in order to encourage an even flow of water through the beverage package. One issue is that freshness of the ingredients cannot be maintained long enough unless an additional airtight package is utilized to over wrap the cartridge. Another problem with such solution lies in that beverage cannot be properly conducted to the recipient (cup, mug, glass, . . . ) after being released from the package.

EP 1 101 430 relates to a beverage filter cartridge system in which pressurized water (about 1.4 to 1.7 bar) is provided in downward direction through the upper side of the cartridge and beverage is collected from a lower side of the cartridge. This document also contemplates the solution in which the pressurized hot water is introduced through the bottom side and upwards into the beverage product. However, in this solution, the inlet traverses the filter and the product cake from bottom and water flows finally downward both through the fluid medium ingredients up to a bottom outlet. According to the patent application, the introduction of pressurized hot water squeezes the beverage powder into a cake and permeates the powder more efficiently.

EP 1 440 903 A1 relates to a cartridge used in a horizontal orientation. The cartridge has a bottom lid that is pierceable in use, by piercing members of a beverage preparation machine, in order to accommodate both inflow and outflow of an aqueous medium to form the beverage from interaction of the medium and the one or more beverage ingredients in the chamber. According to this document, the horizontal positioning of the cartridge during use allows for an optimised flow of the aqueous medium through the cartridge whereas, with vertically oriented cartridges, the water flows too quickly under the influence of gravity and may thus by-pass portions of the beverage ingredients. Therefore, this document claims that a horizontally oriented cartridge allows avoiding this problem, in particular, by arranging for an upward element of flow between the inlet and outlet positions.

However, one has surprisingly found that the darker brewed beverage portion tends to stay in the bottom of the cartridge because of its density that is higher than the rest of the beverage. Therefore, a beverage concentration gradient tends to form within the capsule with the denser beverage portion remaining in the bottom of the capsule; such portion being finally not delivered into the cup. As a result, the resulting tea beverage in the cup may be of insufficient quality despite the use of good quality ingredients. There is a need to overcome this problem.

According to the prior art, external piercing members, which are part of the beverage machine, are usually used to create an inlet to and an outlet from the cartridge. This operation amounts to undesirable physical interaction between the beverage and the machine parts. In particular, cross-contamination may occur when two different cartridges are sequentially brewed without cleaning the machine.

Therefore, the present invention aims at proposing a design for a capsule that enables to maintain freshness of the ingredients, promotes optimal conditions for the preparation of a tea beverage and the like and reduces the cross-contamination problems.

BRIEF SUMMARY OF THE INVENTION

In the present application, the terms "capsule" or "cartridge" or "package" are considered as synonymous. The term "capsule" will be preferentially used. The words "brewing" or "infusion" are used as synonymous. The term "brewing fluid" generally refers to the liquid that serves to infuse the beverage ingredients, more generally, hot water.

In the present application, the term "tea" encompasses all type of leaf tea such as green tea, black tea, white tea, chai tea, flavoured tea and herbal or fruit tea. The term "leaf tea" or "leaf ingredient" refers to brewable tea or other ingredients in whatever form such as complete, cut or chiselled leaves, small fragments of leaves, powder or dust.

The present invention provides a capsule that is adapted to brew or infuse beverages in a beverage machine that may provide the following advantages:

- the quality of the beverage can be improved, in particular, in relation to the beverage concentration into the cup, the taste and the reduced turbidity,
- the capsule is less complicated and less expensive to produce,
- the beverage delivery is cleaner and it reduces or eliminates the taste cross-contamination and hygiene issues,
- the convenience of the capsule handling, i.e., insertion and collection of the used capsules can be improved.

For these purposes as well as many others possible, the invention relates to

A capsule for the preparation of a beverage in a beverage machine comprising:

- a brewing enclosure containing one or more beverage ingredients;
- filtering means delimitating at least one filtering side of the brewing enclosure;
- beverage flow guiding means configured to guide the beverage to a beverage outlet of the capsule;
- a shell and a protective cover that is attached to the shell and forms with the shell a gas tight container for the beverage ingredients;
- wherein
  - said capsule comprises an overflow wall that is positioned in the path of the brewed liquid after the filtering means and which comprises at least one overflow aperture;
  - said capsule further comprising perforation means comprising at least an opening element configured to open the gas-tight container in order to create the beverage outlet from the capsule;
  - said gas-tight container integrally housing the beverage flow guiding means and the perforating element, thereby physically isolating said beverage flow guiding means and said opening element from the exterior.

Therefore, according to one aspect of the invention, the beverage flow guiding means and the opening element are integrally enclosed within the gas-tight capsule until it is used. One advantage of having the opening element and the flow guiding means as a part of the capsule itself is that they are isolated from the external environment. This feature prevents pollution of the flow guiding means during storage before use. Another advantage of having the opening element and the flow guiding means as a part of the capsule is that practically no physical interaction is produced between the beverage and the machine parts, which avoids cross-contamination issues and results in less cleaning.

The opening element is preferably configured to create the beverage outlet in the protective cover. The opening element is a perforating element for perforating an outlet in a wall of the container or an element adapted to create an outlet by breaking a seal between two sealed walls of the container.

The beverage flow guiding means, which have the function of conducting the brewed liquid smoothly to the beverage outlet from the capsule, can also be positioned adjacent to the protective cover.

In a particular embodiment of the present invention, the overflow wall is arranged vertically with the overflow apertures near the top. The cover of the capsule and the overflow wall further face each other, with the beverage outlet placed near the bottom of the cover, and beverage flow guiding means arranged between the overflow wall and the cover in order to guide the brewed liquid from the overflow aperture to the beverage outlet. An advantage of this arrangement is that it promotes a more "direct flow" approach with less chance of the brewed liquid to contaminate parts of the brewing device while ensuring, at the same time, that the liquid overflow is properly carried out in the capsule during brewing so that the ingredients are properly infused and product concentration in the cup is properly controlled.

The perforating element is also preferably housed between the overflow wall and the cover. A portion of the overflow wall can be configured to support the cover and the perforating element can be housed under the cover in a recess or groove formed in the side of the overflow wall facing the cover. Besides housing the perforating element, the recess or groove can also form a beverage channel and thus function as beverage guiding means. This arrangement reduces the complexity of the capsule and thus allows it to be more compact and cheaper to produce.

According to one embodiment of the invention, the perforating element has an elongated shape with two opposing ends and works like a lever. When mechanical localized pressure is applied, through the cover, onto a first end of the element, the other end of the element, in turn, pushes against the cover in order to tear, break or detach it from the shell. The simplicity of this device makes it particularly appropriate for use in a disposable capsule.

According to another embodiment of the invention, the perforation element has an elongated shape with two ends and works like a ram. When pressure is applied onto a first end of the ram-like element, the whole element slides forwards and the second end of the ram-like element pushes against the cover in order to tear, break or detach it from the shell.

The capsule can further be conceived with a certain asymmetry in order to facilitate a proper insertion in the brewing device by the user. For instance, the capsule, and more particularly the cover, can have an asymmetrical egg-shaped or shield-shaped profile with broad topside and more pointed bottom side. As a result, the user is forced to insert the capsule in a predetermined orientation that is desirable for a correct operation of the capsule as aforementioned. In a mode, the capsule can be shield-shaped or ovoid.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
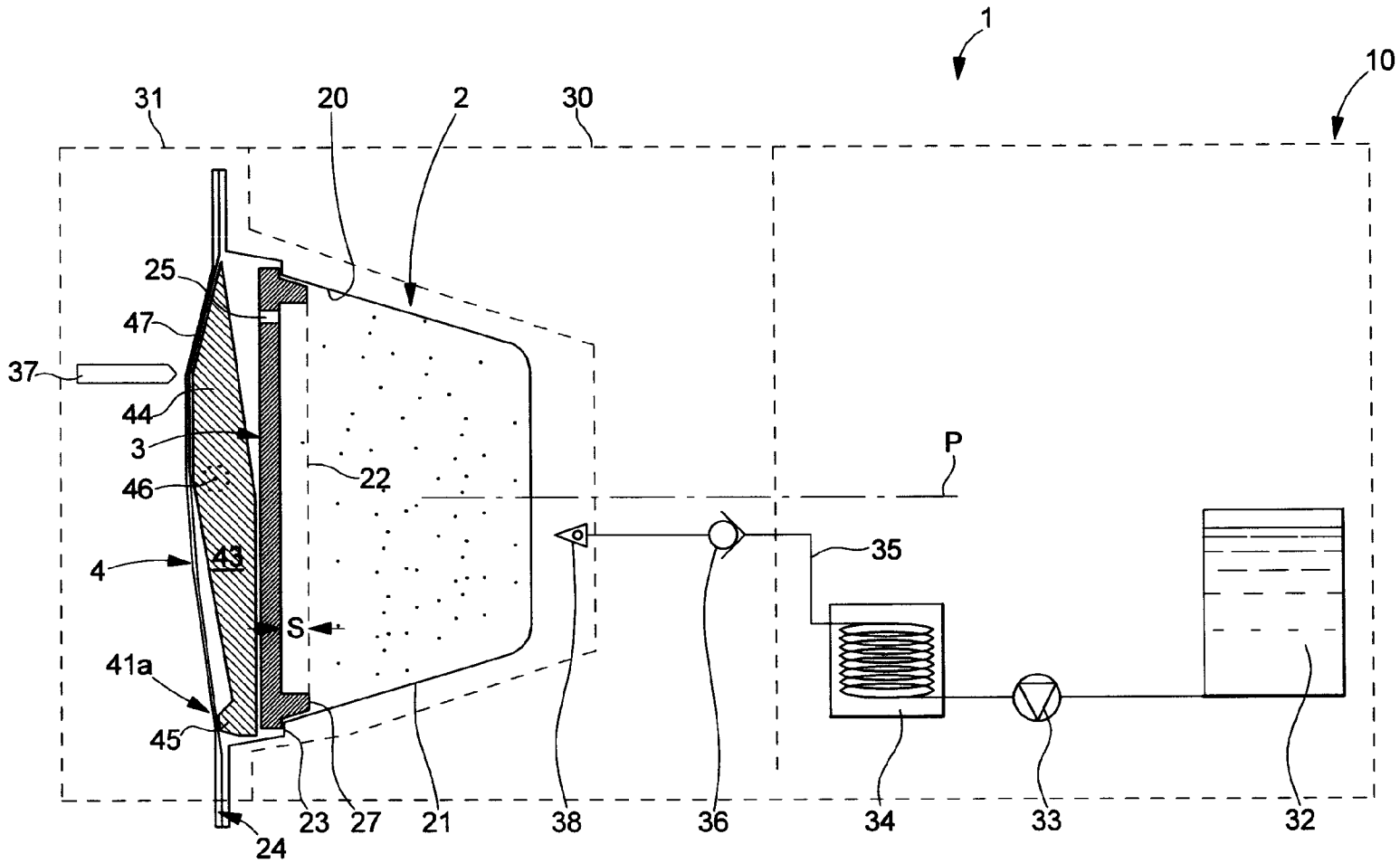
FIG. 1 is a schematic illustration of a capsule brewing system before brewing according to a first embodiment.

First of all, the general brewing principle of the invention will be explained in relation to FIGS. 1 and 2 and a first possible embodiment of the capsule of the invention.

A capsule system 1 is provided that comprises a capsule 2 and a beverage brewing device 10. For simplicity, the beverage brewing device is only schematically depicted and may, in reality, comprise additional technical features within the normal knowledge of the person skilled in the art. The capsule comprises an enclosure 20 containing beverage ingredients such as leaf tea and the like. The enclosure is formed by a cup-shaped housing 21 that is closed by a filtering means 22. The contents of the enclosure are preferably protected from gas and light. The housing may encompass different cross sections such as a triangular, circular, ellipsoid, square, rectangular or polygonal section that determine as a matter of fact the general profile of the filtering wall 22. The enclosure is sized to accommodate a dose of leaf beverage ingredient of typically about between 1 to 10 grams, preferably 2 to 5 grams. The dose of leaf ingredient may depend on the final volume of beverage to produce. For an individual cup of tea, a typical dose can be of about 2 grams whereas for a tea pot, a typical dose can be of about 8 to 10 grams. As clearly apparent in FIG. 1, the capsule is positioned relative to the brewing device so that the filtering wall 22 extends substantially vertical and from substantially the bottom of the enclosure. For this, the capsule is preferably positioned in a "vertical" arrangement in the brewing device 10. The cup-shaped housing 21 can be so oriented with its large opening and its bottom oriented in a vertical position.

The capsule further comprises an overflow wall 3 with at least one overflow aperture 25. The overflow aperture is placed at least above the median horizontal plane P of the enclosure. Preferably, the wall 3 is substantially free of apertures below said median plan P to force the beverage to pass through the aperture(s) 25. The overflow wall is maintained in place by a peripheral inner shoulder 23 of the housing 21. The overflow wall further comprises a peripheral protrusion 27, to which the filtering wall 22 is fixedly attached. As is apparent in FIGS. 1 and 2, the filtering means 22 and the overflow wall 3 are spaced apart a short distance sufficient to create an interstitial space "s" that is supposed, without being bound by theory, to work as a sort of "siphon" that can promote the upward motion of the denser beverage portion that tends to accumulate in the bottom of the enclosure.

The capsule is closed by a cover 4 that hermetically seals the cup-shaped housing 21. This cover is attached to the peripheral outer rim 24 of the housing. The cover can be attached to the peripheral rim by gluing or welding, or any other appropriate technique known to a person skilled in the art. Both the cover and the housing can be made of oxygen barrier materials so as to form an oxygen tight container. In this way, the enclosure 20 can be substantially free of oxygen so that the freshness of the beverage ingredients can be preserved during an extended period of time. The cover 4 can be a flexible membrane or a semi-rigid plastic part. Suitable materials include, but are not limited to, plastics, PET, aluminum foil, polymeric film, paper, and the like.

The enclosure is preferably oxygen free or at least very poor in oxygen and may contain flushed inert gas such as N2, N2O or CO2 to replace air.

A recessed internal channel 40 is formed in the side of the overflow wall 3 that faces the cover 4. The channel 40 leads from the overflow aperture(s) 25 to a tearable or pierceable zone 41*a* of the cover. This zone is intended to be easily torn or pierced by appropriate perforation means in order to create a beverage outlet 41*b*. Alternatively, the tearable or pierceable zone can be replaced by a detachable zone of the cover. This detachable zone being intended to be easily separated from the outer rim 24 of the housing.

A perforating element 43, forming part of the above mentioned perforation means, is housed in the space between the cover 4 and the overflow wall 3. The perforating element 43 is configured to be manoeuvrable from outside the capsule. It can have the general form of an elongated beam with two opposing ends 44, 45. A first one of these ends fans out to form a flattened zone 44, while the other end 45 carries a piercing point 92. The perforating element 43 extends along the internal channel 40 and is flush with the surface of the overflow wall 3 that faces the cover 4. A pivot 46, integral with the perforating element, projects transversally from its centre region. Two recesses on either side of the internal channel 40 are configured to receive and support the two ends of the pivot 46. This arrangement allows perforating element 43 to swing around the pivot 46, while supported by the sides of the channel 40. The piercing point 92, mounted on one end of the beam, faces the tearable, pierceable or detachable zone 41*a* of the cover 4. In order to activate the perforating element 43, pressure is applied onto the flattened end 44 from outside the capsule, across the flexible cover 4. The applied pressure causes the perforating element 43 to swing like a lever. Accordingly, while the flattened end 44 of the beam is pushed in the direction of the overflow wall 3, the pointed end 45 moves away from the overflow wall 3, thus pressing the tearable, pierceable or detachable zone of the cover outwards, with sufficient force to form an opening in the cover or at the seal junction between the cover and the body of the capsule. In this way, a beverage outlet 41*b* is created in the cover 4. The pressure that is applied onto the flattened end 44 of the perforating element 43, in order to create the beverage outlet 41*b*, can be applied manually by the user prior to inserting the cartridge into the brewing device. However, as will be explained hereafter, the pressure is preferably applied by appropriate mechanical means.

The shape of the shell of the capsule is not very critical. For different reasons, preference is given to a truncated cone, or to ellipsoidal or hemispherical shapes. The shell can be manufactured industrially at lower cost by plastic thermoforming or aluminium deep drawing. This shape with smoother corners also favours the removal of the handling members and so ejection of the capsule.

Turning to the brewing device 10, it comprises capsule handling members 30, 31 that are configured to hold the capsule in the "vertical" arrangement as defined. These handling members 30, 31 can be machine jaws or any suitable mechanical enclosing means that can open and close about the capsule and can maintain it firmly in place. There is no need for providing high closing forces since the involved fluid pressure in the capsule remains relatively low and, preferably, as close as possible to the atmospheric pressure. Also, since the capsule can withstand the low brewing pressure therefore the capsule does not necessarily need to be entirely enclosed but simply held water tightly in place during brewing. This participates to a simplification of the machine and reduces machine costs.

The brewing device comprises a water supply 32, such as a water tank, a water pump 33, a heater 34 and a hot water injection line 35 that is managed through the handling member 30. The brewing device may also comprise a controller and a user interface board (not shown) to manage the beverage preparation cycles as known in the art. A backpressure valve 36 can be provided to lower the pressure at the entry side or injection member 38 (such as a needle(s) or blade(s) and a water inlet) in the capsule. Of course, the backpressure valve could be omitted and a low pressure pump could be used that delivers fluid at low pressure. Medium to high pressure pump may however be preferred because of their robustness and reliability and so used in combination with a backpressure valve.

The brewing device may further comprise a mechanical pusher 37 that, in association with the perforating element 43, forms perforation means, which are provided for creating an outlet in the tearable, pierceable or detachable zone 41*a* of the cover 4. As shown in FIG. 1, the mechanical pusher 37 can be activated after closing of the handling members 30, 31 about the capsule. The mechanical pusher is used to manoeuvre the perforating element 43. In order to do so, the mechanical pusher 37 is forced or guided toward the flattened end 44 of the perforating element 43. Moving forwards, the mechanical pusher 37 forces a deformable zone 47 of the flexible cover 4 against the flattened end 44, thus applying local mechanical pressure onto the flattened surface through the cover 4. The local mechanical pressure, thus applied on the upper region of the perforating element, causes the element to tilt and brings about the opening of a beverage outlet 41*b*, as previously described. To avoid any cross-contamination problems, pusher 37 will preferably be arranged so as not to perforate the cover 4 in the deformable zone 47.

In the present example, the mechanical pusher 37 can be driven by a solenoid or any other equivalent drive means or even manually. However, it should be understood that according to the invention, the mechanical pusher could also be dispensed with. In this case, the perforating element 43 would be manoeuvred manually preferably before fitting the capsule 2 into the beverage brewing device 10.

In relation to FIG. 2, the method of the invention works as follows. A capsule is inserted in the brewing device and the capsule handling members are closed about the capsule to position it with the sealing wall being substantially vertically oriented. A beverage outlet 41*b* is created in the cover 4 by the mechanical pusher 37 activating the perforating element 43. On the opposite side of the capsule, the fluid injection member 38 is introduced in the capsule's enclosure. Hot water is thus injected in the capsule at relatively low pressure, preferably, at a pressure not exceeding 1 bar, even preferably 0.2 bar, above atmospheric pressure. Hot water slowly fills the capsule in and submerges the beverage ingredients in the enclosure. The brewed beverage is filtered through the filtering wall 22. A denser portion 5 of the beverage may tend to settle in the bottom of the enclosure; which portion is also filtered through the filtering wall since it is properly placed adjacent this portion. The denser beverage is evacuated through the interstitial space "s" as caused by the variation of pressure between the lower part of the space and the upper part of said space therefore acting similarly to a "siphon". The rest of the beverage is also filtered also by passing through the filtering wall at different vertical levels up to the upper level of the fluid in the enclosure and is evacuated to the overflow aperture 25.

It should be noted that the overflow aperture(s) should preferably be placed above the ¾ of the total height of the enclosure and even preferably be placed above the ⅘ of the total height of the enclosure; thus ensuring a more complete submergence of the beverage ingredients and a slower evacuation of the beverage from the enclosure which favours a better infusion process.

The "total height" of the enclosure is meant to be the total distance separating the lowermost point of the enclosure to the uppermost point of the enclosure when the capsule is positioned in the beverage machine ready for the brewing operation. In a possible mode, the filtering wall can be substantially equal to the total height of the enclosure.

It can be noted that a "direct flow" can be obtained where the brewed liquid is dispensed directly into the recipient 6 (e.g., cup, mug and the like). By "direct flow", it is meant that the outlet is arranged in respect to the brewing device so that the brewed liquid does not encounter any permanent device or part when leaving the outlet. In other words, the outlet is placed sufficiently low and laterally spaced from the capsule handling members to avoid any significant contact of the liquid with these members when released.

Figure 3:
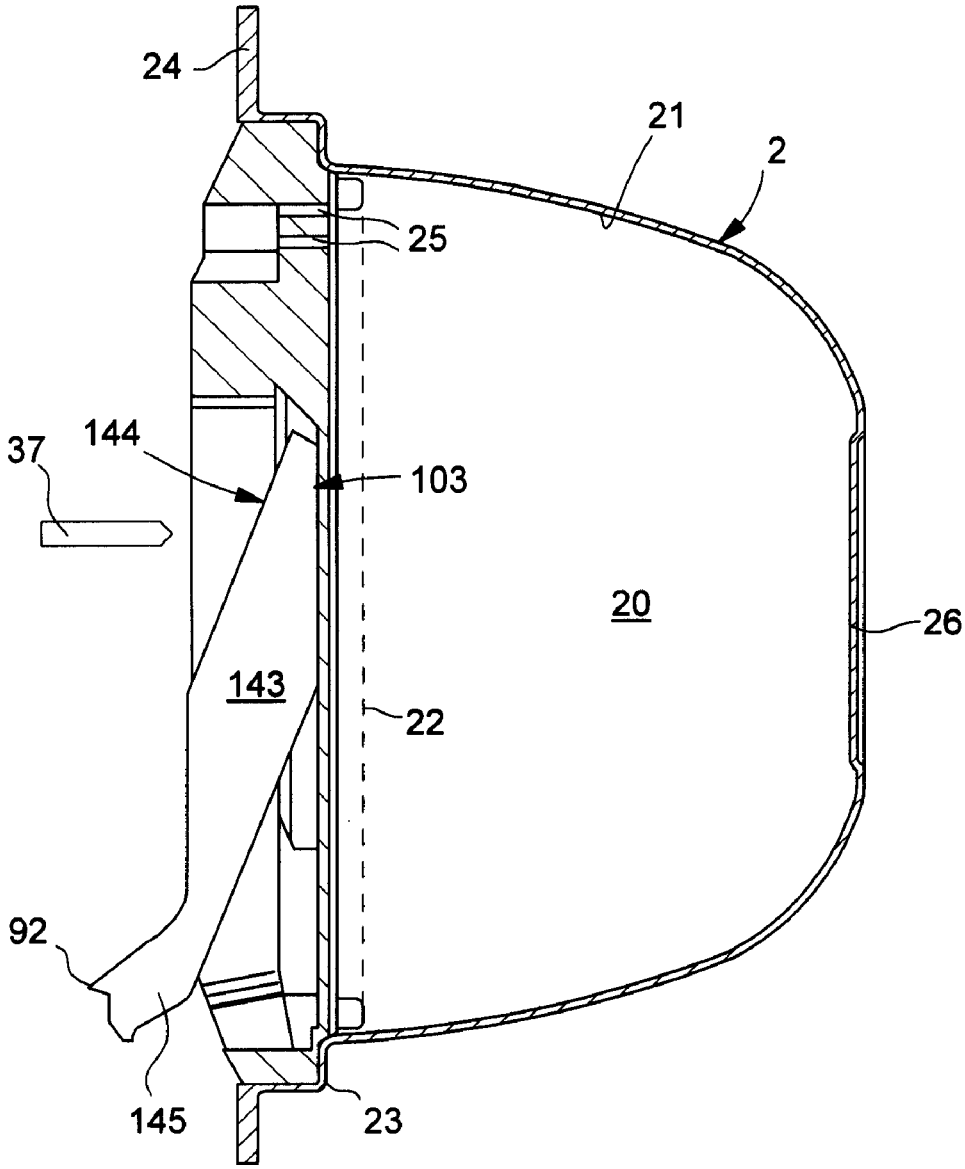
FIG. 3 is a cross-sectional view of a capsule according to a second embodiment of the invention.
Figure 4A:
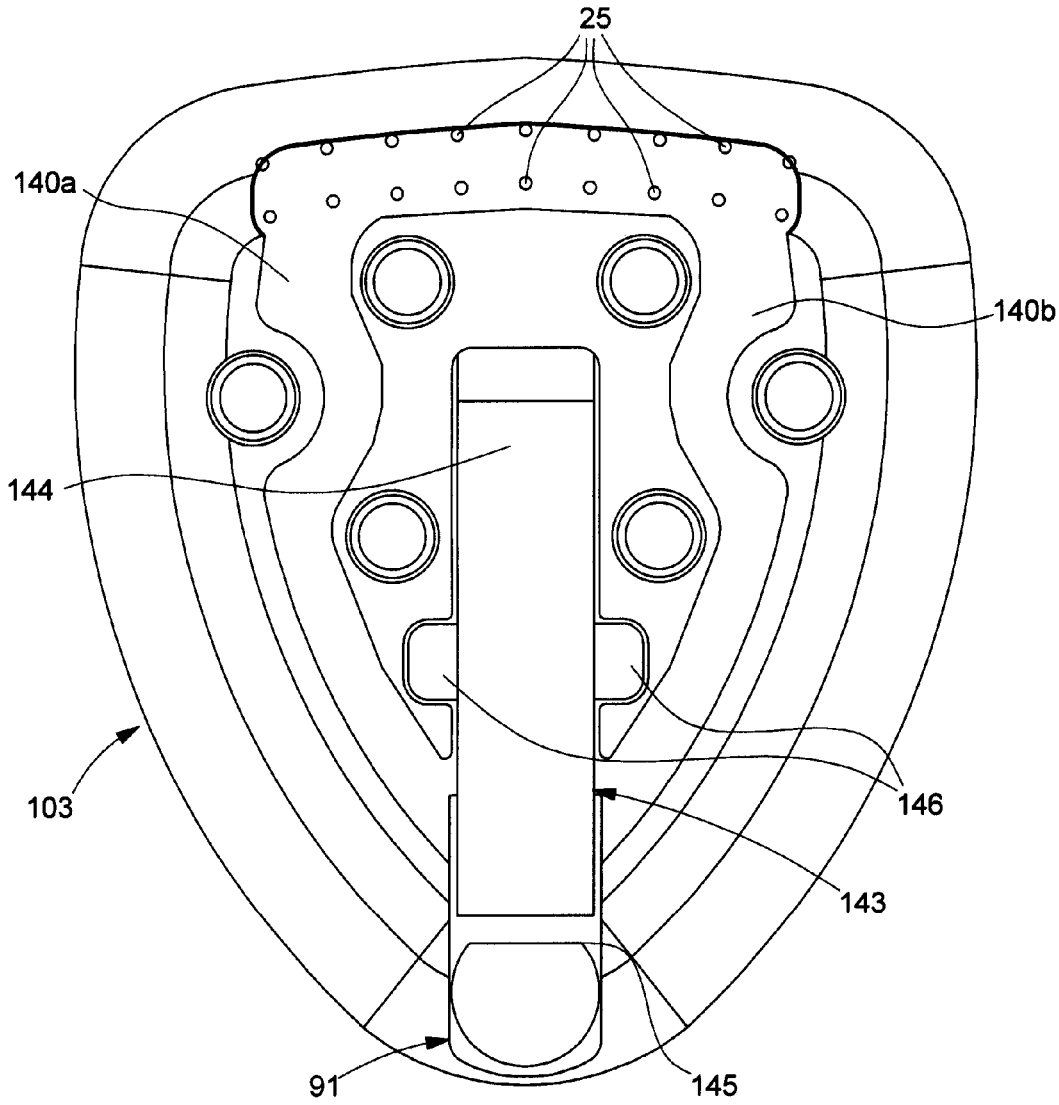
FIG. 4*a* is a plane view of the capsule of FIG. 3 with the cover removed in order to show the perforating element and the beverage flow guiding means.
Figure 4B:
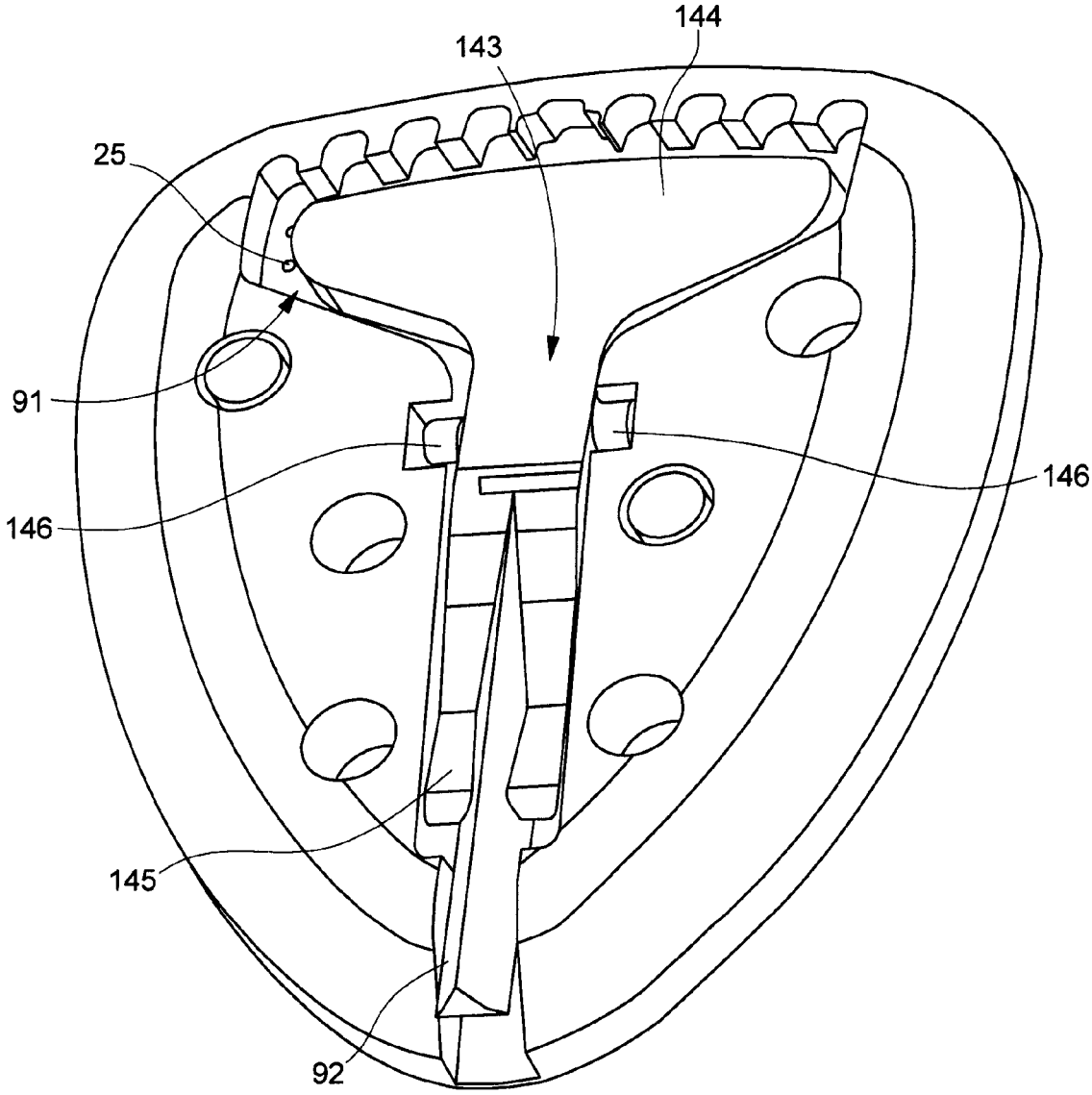
FIG. 4*b* is a plane view of a slightly different embodiment of the capsule of the invention with the cover removed in order to show the perforating element and the beverage flow guiding means.
Figure 5:
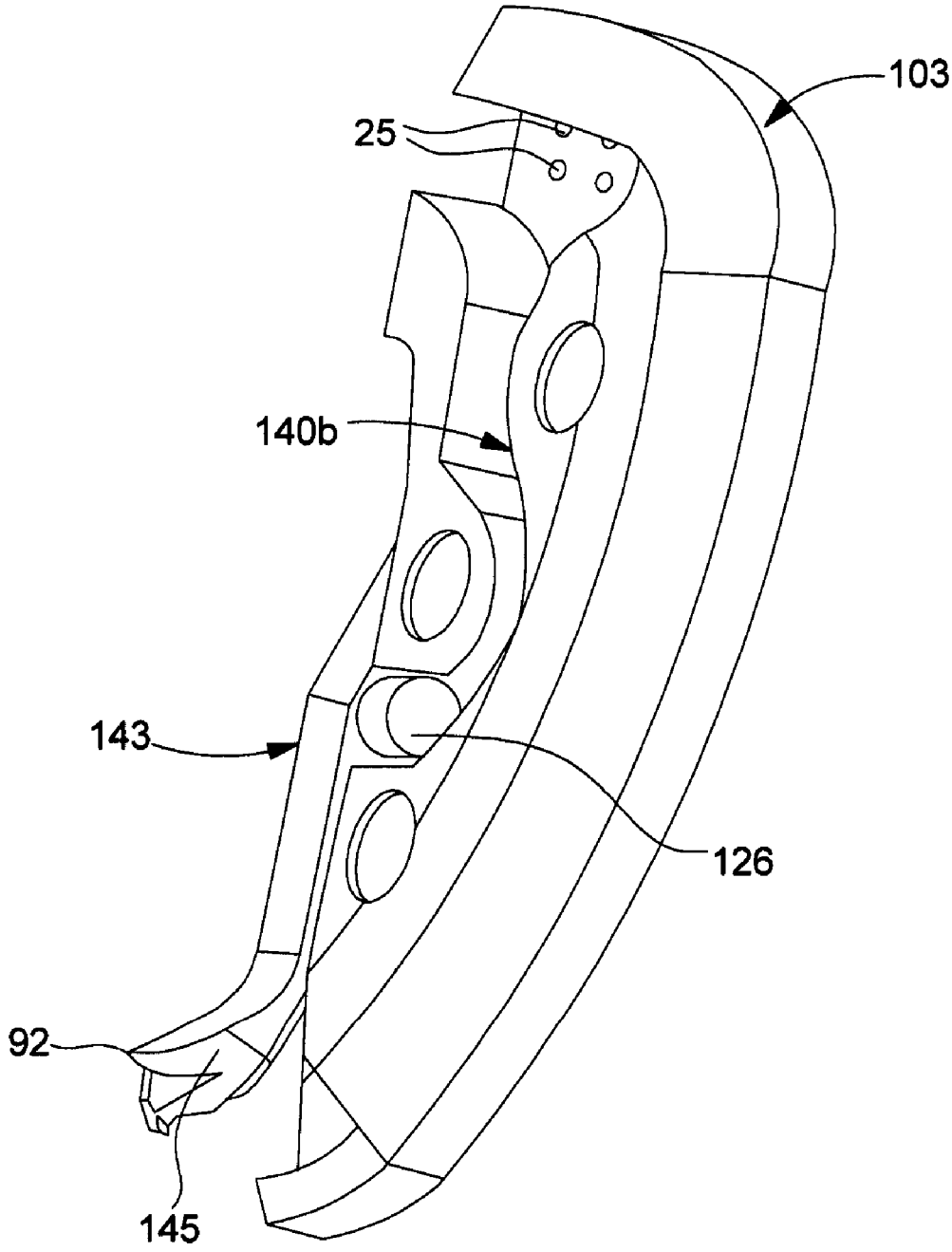
FIG. 5 is a perspective view of the overflow and support wall of the capsule of FIG. 3 showing the position of the perforating element during brewing.

A second embodiment of the capsule of the invention is illustrated in relation to FIGS. 3 to 5. These figures illustrate a variant of the beverage capsule 2 for carrying out the method of the invention.

The beverage capsule 2 comprises an enclosure 20 for containing one or more beverage ingredients. The enclosure 20 is defined by the assembly of a cup-shaped shell 21 and a filtering means 22. A cover 4 (not shown in FIG. 3) closes the shell 21 hermetically. Cover 4 comprises a peripheral rim that is attached to the peripheral rim 24 of the shell 21. The connection between the cover and shell can be made by gluing, welding, snap fitting and any combinations thereof. As will be explained in detail further on, the cover 4 also features two relatively small weakened or breakable zones. The capsule further comprises an overflow and support wall 103 that is generally parallel to the filtering wall and forms a separation between it and the cover. The uppermost part of the overflow wall 103 further comprises a number of overflow apertures 25.

As shown in FIG. 4*a*, two lateral channels 140*a* and 140*b* run along the side of the wall 103 that faces the cover 4. The channels extend from either side of the overflow apertures 25 to a location where the lateral channels join near the lowermost part of the overflow and support wall 103. The side of the overflow and support wall facing the cover further comprises a vertical groove 91 housing a perforating element 143 that extends along the groove and can be manoeuvred from outside the capsule. As depicted, the peripheral channels 140*a* and 140*b* are in a symmetrical arrangement in relation to groove 91. The channels are intended to guide beverage from the overflow apertures 25 into the lower part of vertical groove 91. This arrangement allows the brewed liquid to be kept away from the upper part of the groove and from the upper end 144 of the perforating element 143.

The perforating element 143 is shaped generally like a beam with an upper end 144 and a lower end 145 and a parallelepiped cross-section (visible in FIG. 3). The upper end 144 has a flat top, while the lower end 145 is rounded in shape and carries a piercing point 92 (visible in FIG. 3). The perforating element is designed to swing around a pivot 146 supported by the sides of the groove.

Figure 2:
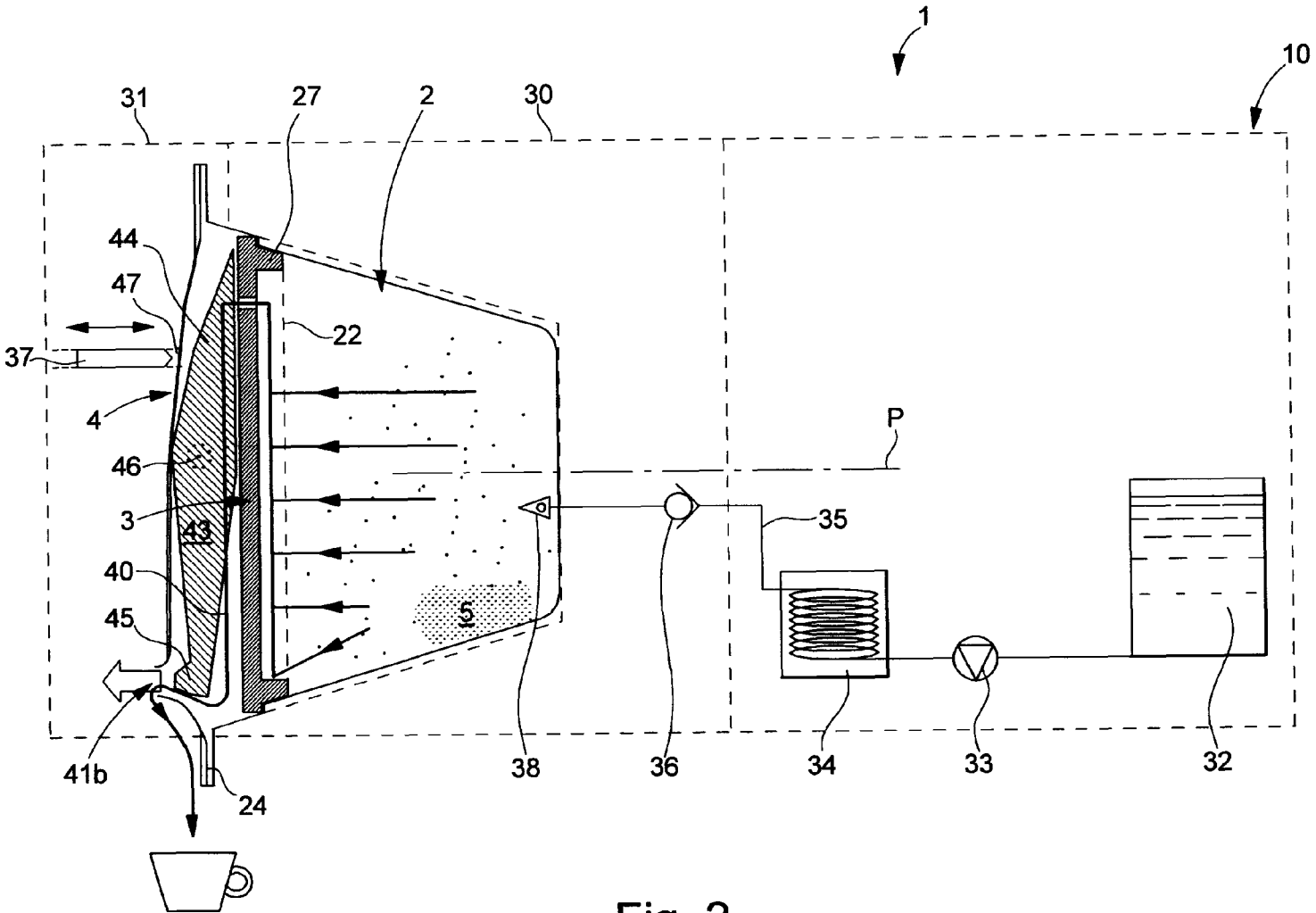
FIG. 2 is a schematic illustration of a the capsule brewing system of FIG. 1 during brewing of the capsule of the invention.

As was already the case with the embodiment depicted in FIGS. 1 and 2, the perforating element 143 is preferably manoeuvred via a mechanical pusher. The mechanical pusher 37 is forced or guided toward the upper end 144 of the perforating element 143. As the perforating element 143 lies under the cover 4, the mechanical pusher cannot apply pressure directly onto the upper end 144. Accordingly, the cover 4 preferably comprises a folded or deformable zone (not shown in the figures), which is configured to be pushed into contact with the upper end 144 by the pusher 37.

According to another arrangement, the mechanical pusher 37 could first perforate and go through the cover 4. In this case, a perforable zone of the cover 4 would be provided near the upper end 144 of the perforating element 143. The pusher 37 could thus press on the upper end 144 by first piercing this first perforable zone of the cover 4. As already mentioned, the beverage flow, out of the overflow apertures 25, is guided by the lateral channels 140*a* and 140*b*. Thanks to this arrangement, the beverage is kept away from the upper part of groove 91. This feature is particularly important in the case where the mechanical pusher 37 goes through the cover 4. By keeping the beverage away from the mechanical pusher, the lateral channels 140*a* et 140*b* can avoid any contact between the beverage and the mechanical pusher 37 or any contaminating substance or particles that might have entered the capsule with the pusher.

The piercing point 92 carried by the lower end 145 of the perforating element 143 faces a second perforable zone 141*a* of the cover 4. When pressure is applied by the mechanical pusher onto the upper end 144, The pressure causes the perforating element 143 to swing like a lever. Accordingly, while the flattened upper end 144 of the beam is pushed in the direction of the overflow wall 103, the lower end 145 moves away from the overflow wall 103, thus causing the piercing point 92 to perforate the second weakened or breakable zone of the cover, creating a beverage outlet 141 in the cover 4. Once the mechanical pusher 37 has caused the piercing element 143 to complete its swinging movement, the pusher can retract out of the capsule. However, the piercing element remains in the position depicted in FIG. 3 with its lower end 145 extending out of the beverage outlet 141*b*. In this position, the lower end 145 of the piercing element can function as beverage guide, surface tension causing the beverage naturally to run along the surface of the lower end 145, until it falls directly from the lower tip of the piercing element 143 into a cup.

FIG. 4*b* depicts a slightly different embodiment of the invention in which the perforating element 143 is of a greater length. More precisely, the distance separating the pivot 146 from the piercing point 92 is considerably greater than in the example of FIG. 4*a*. One advantage of this feature is that any backward movement of the upper end 144 is accompanied by a much wider movement of the piercing point 92. Accordingly, the pusher 37 does not have to push the upper end 144 as far back. This reduces the risk of the flexible cover 4 being pierced by the mechanical pusher 37.

Returning to FIG. 4*a*, one can see that the beverage flow conducting means 140*a* and 140*b* are parallel to the overflow wall. As a result, the capsule can be oriented vertically, e.g., with the overflow wall vertically oriented, in order for the flow to be directed down to the cup via the beverage flow conducting means 140*a*, 140*b* and the beverage outlet 141*b*. One advantage is that the capsule is "direct flow" in the sense that the beverage that leaves the machine falls down directly into the cup without touching any part of the machine. The benefits are so less taste cross-contamination and reduced cleaning.

As more particularly shown in FIGS. 4*a* and 4*b*, the capsule can also be shaped to promote and indicate to the user a particular direction for insertion into the brewing device. For instance, the capsule, more particularly the cover, can have an asymmetrical egg-shaped or shield-shaped profile with broad topside and more pointed bottomside.

At the rear of the housing 21, the wall of the shell can comprise a recessed portion 26 that constitutes the injection region for the introduction of the fluid into the capsule. The recessed portion can be so conceived as to resist the compressive forces associated with the introduction of the injection device 38 (depicted in FIGS. 1 and 2), and to puncture its centre more easily. The recessed portion can also comprise an injection hole covered by a puncturable membrane.

A third embodiment of the capsule of the invention is illustrated in relation to FIGS. 6 to 9. These figures illustrate a variant of the beverage capsule 2 for carrying out the method of the invention.

As can be seen in the figures, the beverage capsule 2 is generally shaped like an elongated box 221 with a rounded front side 222. A plurality of small holes 226 is provided in the lower part of the rounded front side in order for this side to function as a filtering wall. The inside of the box-shaped capsule forms an enclosure 220 for containing one or more beverage ingredients. The enclosure 220 is formed by the box-shaped shell 221 and by a cover 204 that closes and hermetically seals the open underside of the shell 221. The cover 204 (shown only in FIG. 8) also wraps around the shell, extending over both the rounded front side 222 and the top of the shell. On the bottom side, the cover 204 is attached to the lower rim 224 (FIG. 9) of the shell. The connection between the cover and the shell can be made by gluing, welding, snap fitting and any combinations thereof. The front and top sides of the shell also comprise two lateral shoulders 223*a*, 223*b* onto which the cover 204 is attached.

Figure 6:
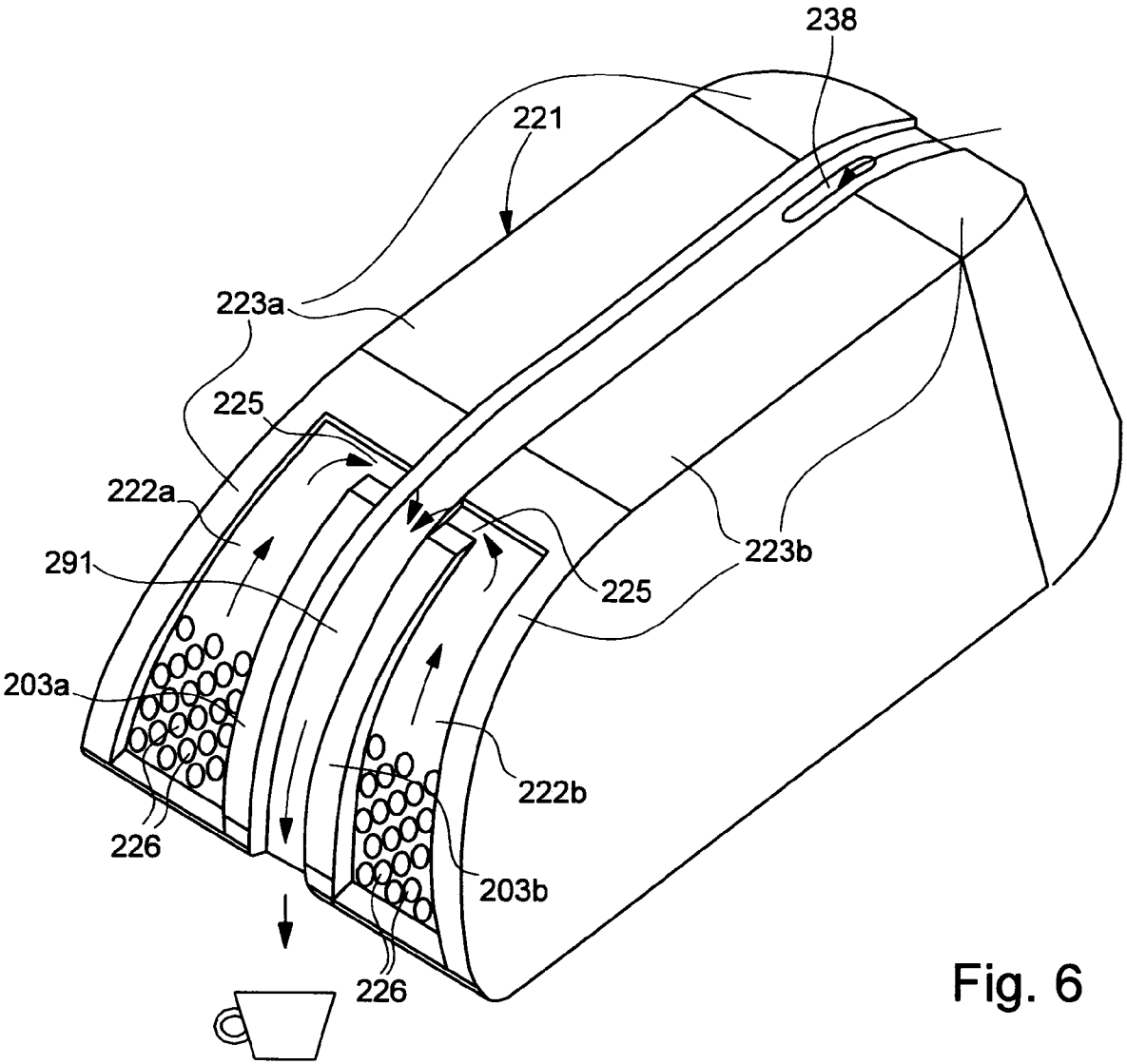
FIG. 6 is a perspective external view of the shell of the capsule according to a third embodiment of the invention.
Figure 7:
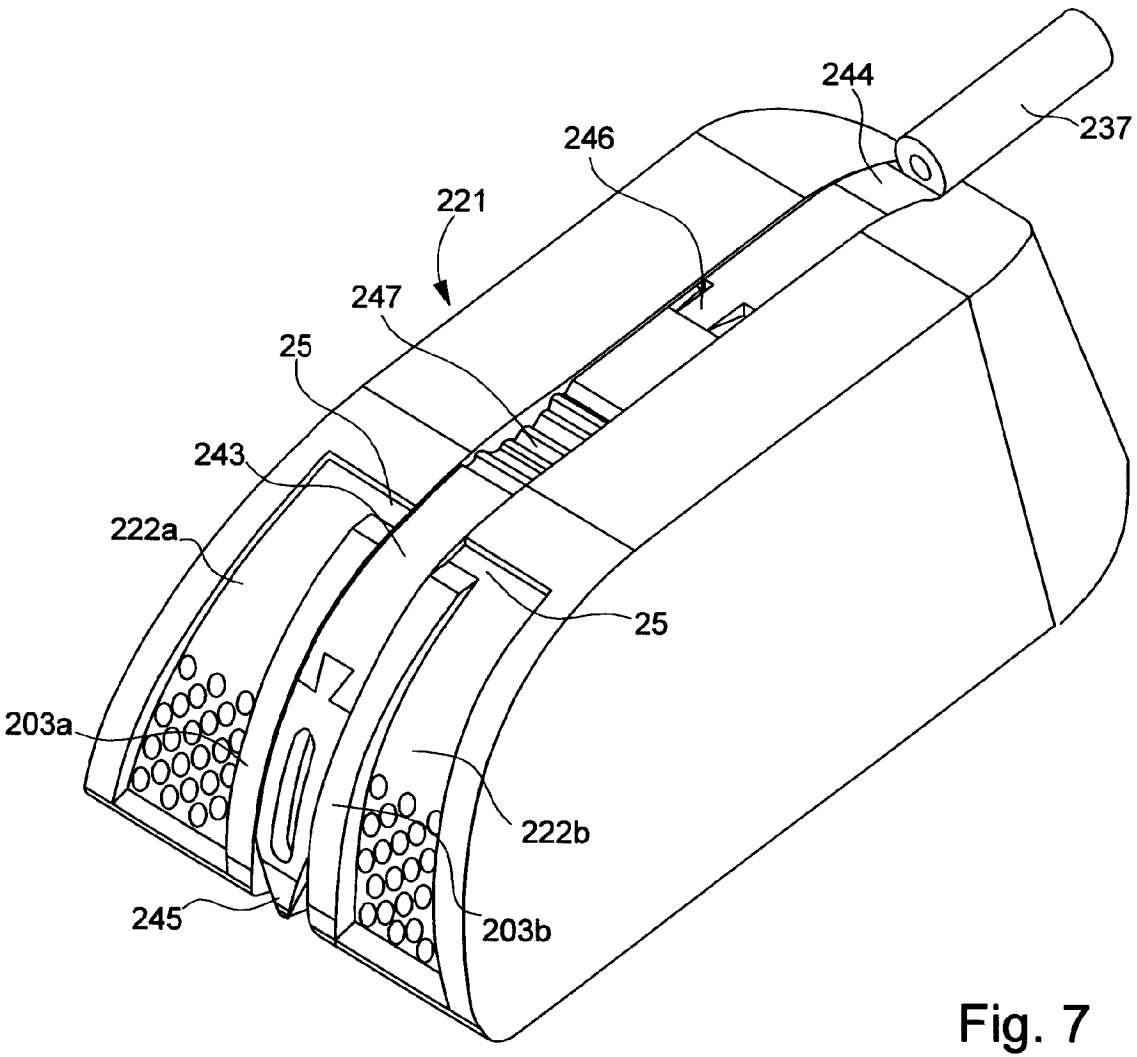
FIG. 7 is a perspective external view showing the shell and the perforating element of the capsule of FIG. 6.
Figure 8:
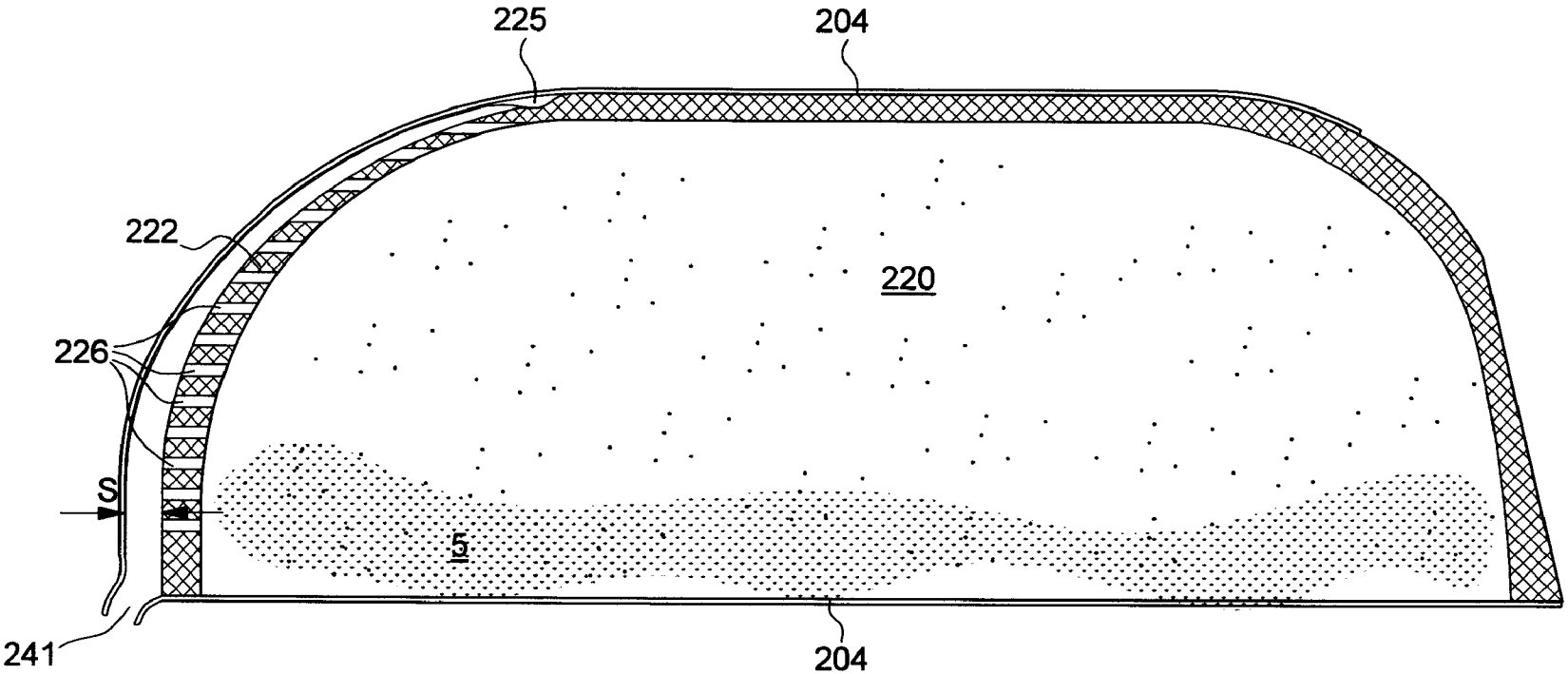
FIG. 8 is a cross-sectional view of the capsule of FIG. 6.
Figure 9:
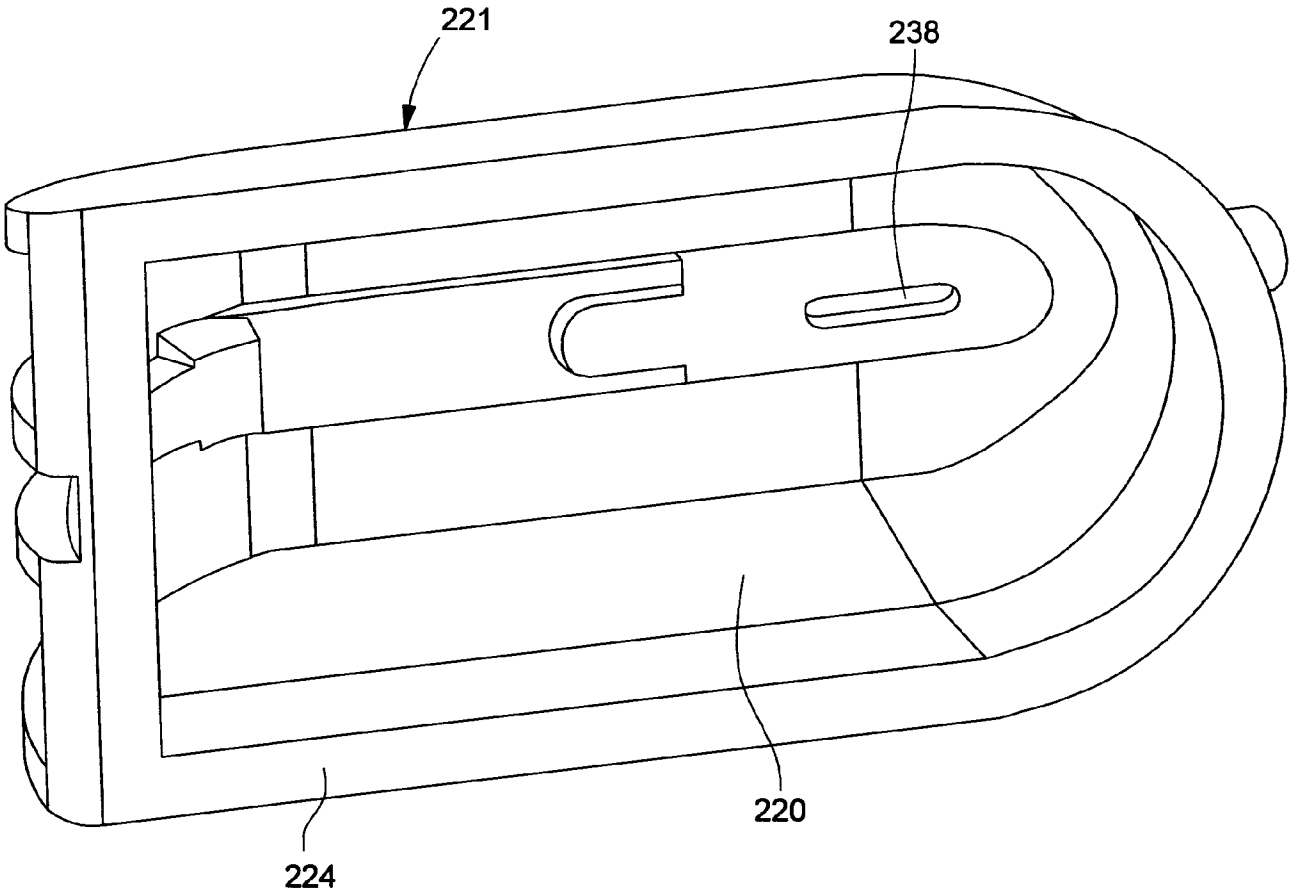
FIG. 9 is a perspective internal view of the shell of the capsule of FIG. 6.

As shown in FIG. 6, the front and top sides of the shell 221 further comprise an axial groove 291. On the top side of the shell 221, an aperture 238 is further provided through the bottom of the groove. As will be explained later on, this opening 238 between the rear part of the groove 291 and the enclosure 220 functions as a hot water inlet for the capsule. The groove 291 further receives a perforating element 243 (depicted in FIG. 7). The perforating element is designed to be integrally housed under the cover 204. As can be seen in FIG. 7, before the perforating element is used, its rear part 244 covers the hot water inlet 238. The groove 291 further extends right down the middle of the front side, and divides the filtering wall into two halves 222*a*, 222*b*. On the front side, this portion of the groove also serves the function of an internal beverage channel. Two guiding shoulders 203*a*, 203*b* run parallel to the groove 291, on either side of it, and form a separation between the beverage channel and the filtering walls 222*a*, 222*b*. As previously described, the cover 204 wraps over the front side of the shell. On this front side, the cover is supported by both the lateral shoulders 223*a*, 223*b* and the guiding shoulders 203*a*, 203*b* in such a way that the cover is maintained a short distance (referenced "s" in FIG. 8) away from the filtering walls 222*a*, 222*b*. In this way, two interstitial spaces or chambers are formed between the filtering walls 222*a*, 222*b* and the portions of the cover 204 facing the filtering walls. Each of these interstitial chambers is closed on one side by one of the guiding shoulders 203*a*, 203*b*. As depicted in FIGS. 6 and 7, an overflow aperture 225 is further provided in the top part of each guiding shoulder.

This overflow aperture allows beverage from the two interstitial chambers to flow into the groove 291. The guiding shoulders 203*a*, 203*b* therefore serve the function of two overflow walls between each half of the filtering wall and the beverage channel.

In the present embodiment, the perforating element 243 basically resembles a curved rod with a pointed end. This rod-shaped perforating element extends along practically the full length of the groove 291. The perforating element 243 is designed to slide forward along the groove 291 when pressure is applied to its rear. This forward movement of the perforating element 243 causes its pointed front-end 245 to pierce the cover 204 and create a beverage outlet 241 at the very bottom of the front side of the capsule.

During its forward movement, a portion (referenced 247) of the perforating element, which was originally positioned on the flat top of shell 221, moves onto the front of the shell, which has a rounded profile. As is visible in FIG. 7, the material forming portion 247 is thinned out in order to render it flexible. The presence of the flexible portion 247 allows the perforating element to follow the curved profile of shell 221. However, one should understand that the necessary flexibility could also be achieved by designing a perforating element comprising hinged elements, or even by combining flexible portions and hinges.

As in the embodiment depicted in FIGS. 1 and 2, the perforating element 243 is preferably manoeuvred via an external mechanical pusher 237 (depicted in FIG. 7). The mechanical pusher 237 is forced or guided toward the rear end 244 of the perforating element 243. In order for the mechanical pusher to come into contact with the perforating element 243, it must first go through the cover 204. In the present embodiment, the external pusher 237 is shaped like a hollow tube with a relatively sharp front rim. Therefore, when the mechanical pusher 237 comes to press against the zone of the cover 204 that covers the rear of the perforating element 243, the sharp front rim allows the pusher 237 to cut right through the cover 204, and press directly on the rear end 244 of the perforating element 243.

In relation to this last embodiment, the method of the invention is basically the following. A capsule is inserted into a brewing device in which it is held in position. The mechanical pusher 237 comes to press against the cover at the rear of the perforating element. The mechanical pusher cuts through the cover 204 and pushes the perforating element forwards. The forward movement of the perforating element 243 causes its pointed front-end 245 to pierce the cover 204, thus creating a beverage outlet 241 at the front end of the groove 291. The forward movement of the perforating element 243 also causes its rear end 244 to come clear of the water inlet 238. The brewing device can then supply water to the inlet 238 through the hollow tube forming the mechanical pusher 237. Hot water from the hollow tube is guided through the rear end of the groove 291 and the water inlet 238 into the brewing enclosure 220. The perforating element 243 further comprises sealing means 246 (visible in FIG. 7). These sealing means are designed to keep any of the hot water supplied through the hollow tube 237 from escaping down the groove 291

Hot water slowly fills the capsule and submerges the beverage ingredients in the enclosure. The brewed beverage is filtered through the filtering walls 222*a*, 222*b*. A denser portion 5 of the beverage may tend to settle in the bottom of the enclosure; which portion is also filtered through the filtering wall since it is properly placed adjacent this portion. The filtered beverage is evacuated from the interstitial chambers trough the overflow apertures 225*a*, 225*b*, as caused by the variation of pressure between the lower and the upper part of the chamber therefore acting similarly to a "siphon". The beverage can finally flow, down the groove 291 and through the beverage outlet 241 of the capsule, directly into a cup.

The invention claimed is:

1. A capsule for the preparation of a beverage in a beverage machine comprising:

a brewing enclosure comprising at least one beverage ingredient;

filtering means defining at least one filtering side of the brewing enclosure;

beverage flow guiding means for guiding the beverage to a beverage outlet of the capsule;

a shell and a protective cover attached to the shell and forming with the shell a gas tight container for the beverage ingredients;

an overflow wall that is located in a path of a brewed liquid after the filtering means and comprises at least one overflow aperture, wherein the overflow wall and the cover face each other, and a portion of at least the side of the overflow wall facing the cover is designed to support the cover, and wherein the beverage flow guiding means comprise a beverage flow channel located on the side of the overflow wall facing the cover and connects at least one overflow aperture with the beverage outlet;

perforation means comprising an opening element designed to open the gas-tight container in order to create the beverage outlet;

the gas tight container integrally housing the beverage flow guiding means and the opening element; and a groove formed in a side of the overflow wall facing the cover that is designed to house the perforating element, and a downstream portion, at least, of the beverage flow channel extends along said groove, wherein the beverage flow channel extends along the whole length of the groove, and the first opposing end of the perforating element fans out to form a flattened zone that faces a plurality of overflow apertures.

2. A capsule for the preparation of a beverage in a beverage machine comprising:

a brewing enclosure comprising at least one beverage ingredient;

filtering means defining at least one filtering side of the brewing enclosure;

beverage flow guiding means for guiding the beverage to a beverage outlet of the capsule;

a shell and a protective cover attached to the shell and forming with the shell a gas tight container for the beverage ingredients;

an overflow wall that is located in a path of a brewed liquid after the filtering means and comprises at least one overflow aperture;

perforation means comprising an opening element designed to open the gas-tight container in order to create the beverage outlet;

the gas tight container integrally housing the beverage flow guiding means and the opening element; and a perforating element having a generally elongated shape with a first opposing end and a second opposing end, and the perforating element is so constructed and arranged to be moveable from a starting position to an in use position when a mechanical pressure is applied onto the first opposing end, the second opposing end being configured to pierce the protective cover when the perforating element is moved into the in use position, wherein the opening element is designed to pivot so that pressure applied onto the first opposing end, through the cover, causes the second opposing end to swing towards the cover.

3. The capsule according to claim 2, wherein the opening element is designed to pivot around a transversal axle that is integral with the perforating element.

4. A capsule for the preparation of a beverage in a beverage machine comprising:

a brewing enclosure comprising at least one beverage ingredient;

filtering means defining at least one filtering side of the brewing enclosure;

beverage flow guiding means for guiding the beverage to a beverage outlet of the capsule;

a shell and a protective cover attached to the shell and forming with the shell a gas tight container for the beverage ingredients;

an overflow wall that is located in a path of a brewed liquid after the filtering means and comprises at least one overflow aperture;

perforation means comprising an opening element designed to open the gas-tight container in order to create the beverage outlet;

the gas tight container integrally housing the beverage flow guiding means and the opening element; and a perforating element having a generally elongated shape with a first opposing end and a second opposing end, and the perforating element is so constructed and arranged to be moveable from a starting position to an in use position when a mechanical pressure is applied onto the first opposing end, the second opposing end being configured to pierce the protective cover when the perforating element is moved into the in use position, wherein the perforating element is designed to function like a ram, pressure applied onto the first opposing end causing the perforating element to slide longitudinally into the in use position, with the second opposing end extending out of the cover, and wherein the perforating element is housed in a curved groove facing the cover and extending from a front side to the top side of the capsule, and the perforating element comprises a flexible portion designed to allow the perforating element to move along the groove from the starting position to the in use position.

5. The capsule according to claim 4 wherein the first opposing end is designed to be moved by an external mechanical pusher, and a portion of the cover, between the mechanical pusher and the first opposing end, is designed to be pierced by the mechanical pusher.

6. The capsule according to claim 5 comprising a hot water inlet located at the bottom of a portion of the groove, the inlet being covered by the first opposing end when the perforating element is in the starting position, and being uncovered when the perforating element in the in use position.

7. The capsule according to claim 6 wherein it is supplied with hot water through the portion of the cover pierced by the mechanical pusher and through the hot water inlet.

8. The capsule according to claim 7 wherein the perforating element comprises sealing means located near the first opposing end, the sealing means being designed to prevent hot water supplied through the portion of the cover pierced by the mechanical pusher to escape along the groove instead of flowing through the hot water inlet.

* * * * *